United States Patent [19]

Noland

[11] 4,263,962

[45] Apr. 28, 1981

[54] HEAT PUMP CONTROL SYSTEM

[75] Inventor: Joseph R. Noland, Crestwood, Ky.

[73] Assignee: General Electric Company, Louisville, Ky.

[21] Appl. No.: 806,032

[22] Filed: Jun. 13, 1977

[51] Int. Cl.[3] ..... F25B 29/00

[52] U.S. Cl. ..... 165/17; 62/160; 219/485; 165/29

[58] Field of Search ..... 165/29, 28, 17; 62/156, 62/160; 219/485, 486, 487

[56] References Cited

U.S. PATENT DOCUMENTS

| | | | |
|---|---|---|---|
| 2,806,674 | 9/1957 | Biehn | 165/29 X |
| 3,006,613 | 10/1961 | Coyne | 165/29 X |
| 3,131,549 | 5/1964 | Rhea | 62/228 |
| 3,159,981 | 12/1964 | Huskey | 62/156 |
| 3,273,635 | 6/1969 | Jobes | 165/29 X |
| 3,348,607 | 10/1967 | Cootey | 165/28 |
| 3,404,729 | 10/1968 | Armott et al. | 165/29 |
| 3,444,923 | 5/1969 | Kyle et al. | 165/29 |
| 3,447,335 | 6/1969 | Ruff et al. | 62/159 |
| 3,461,681 | 8/1969 | Smith et al. | 62/180 X |
| 3,466,888 | 9/1969 | Kyle | 62/156 |
| 3,474,639 | 10/1969 | Smith | 62/160 |
| 3,529,659 | 9/1970 | Trask | 165/29 |
| 3,901,308 | 8/1975 | Berger | 165/2 |
| 4,024,722 | 5/1977 | McCarty | 62/160 X |
| 4,102,391 | 7/1978 | Noland et al. | 165/29 |

*Primary Examiner*—Albert W. Davis
*Assistant Examiner*—Margaret A. Focarino
*Attorney, Agent, or Firm*—Frank P. Giacalone; Radford M. Reams

[57] ABSTRACT

A control for a self-contained refrigeration system air conditioner unit having a heating and cooling operation. The control provides for defrosting the evaporator and for supplying supplemental heat under selected temperature conditions. A lack of heating capacity by the air conditioner in the heating operation when the outdoor temperature is below a predetermined temperature is supplemented by a first and second heater in combination with the air conditioner refrigeration system heating operation.

6 Claims, 2 Drawing Figures

5
18
30
31
33
32
23
26
10
12
25
11
20
21
22
27
29
19
14
44
46
47
45
16

38
36
26
40
32
42
34
35
31
66
41
34a
34b
35a
67
46
61
30
58
53
56
14
62
59
21
57
63
60
58
29
44
52
55
50
54
48
49

HEAT PUMP CONTROL SYSTEM

BACKGROUND OF THE INVENTION (1) Field of the Invention

The present invention relates to reverse cycle heat pump and more particularly to a control system for providing defrosting and supplemental heat in the heating cycle.

(2) Description of the Prior Art

Heat pump air conditioners are required to heat an enclosure under all outdoor ambient temperatures. In the heating mode the outdoor heat exchanger functions as the evaporator and accordingly may operate at such low ambient temperatures to cause the accumulation of a coating or layer of frost. Since such a layer of frost operates as a barrier to heat transfer between the evaporator and the air being circulated over the evaporator, the efficiency of the unit is markedly reduced. Also, unless means are provided for interrupting this accumulation of frost, the evaporator can become completely filled or covered with a layer of frost which may eventually cause compressor motor or other damage to the unit.

It has been customary in some present units to shut down the unit until the frost has melted. Another practice is to reverse the refrigerant system so that the outside heat exchanger functions as the condenser to melt accumulated frost. In both of these systems, the heating function is interrupted until the frost is eliminated and the system once again can function in the heat mode. Since these interruptions during extreme cold outdoor ambient temperatures can be frequent, it results in uneven temperatures generally below the accepted comfort range.

U.S. Pat. No. 3,159,981-Huskey, assigned to the General Electric Company, assignee of the present invention, discloses a self-contained air conditioning unit including a reversible refrigeration system and a control circuitry designed to interrupt the operation of the refrigeration system whenever either the outdoor or indoor heat exchanger attains a frosting temperature and to supply auxiliary heat to an enclosure whenever the operation of the refrigeration system is thus interrupted during a heating cycle. The frost control switch includes a vapor-filled bellows and capillary tube sensing element connected to the bellows. The tube is arranged with a first portion in contact with one of the heat exchangers and a second portion in contact with the other heat exchanger whereby the bellows operated switch will stop the compressor when either heat exchanger attains a frosting temperature.

Another prior art attempt at solving the frosting of the outdoor heat exchanger when in the heating cycle it is operating as an evaporator, is disclosed in U.S. Pat. No. 3,466,888-Kyle. The control circuitry includes a first thermistor in heat exchange contact with the outdoor coil and a second thermistor is exposed to the temperature of the outdoor air. The two thermistors are connected in series. When frost forms on the surface of the outdoor heat exchanger, the temperature of the refrigerant therein decreases, and the voltage at the junction of the thermistor changes, and operates a control circuit which stops the fan of the outdoor coil, and reverses the flow of refrigerant so that the outdoor coil operates as a condenser coil to melt the frost.

U.S. Pat. No. 3,348,607-Cootey discloses a split-bulb or dual bulb thermostat wherein a sensing element is located in the path of return air and the other in the outdoor or ambient air. The sensing elements are proportioned in size relative to each other and both elements transmit motion to a single power element in response to changes in the temperature of the air affecting the elements.

SUMMARY OF THE INVENTION

The present invention relates to a control for a self-contained air conditioning unit for heating and cooling an enclosure. The refrigerant circuit includes an outdoor heat exchanger, an indoor heat exchanger, a valve for selectively connecting the compressor to the heat exchangers whereby the outdoor heat exchanger functions as an evaporator during operation of said unit on the heating cycle and the indoor heat exchanger functions as an evaporator during operation of the unit on the cooling cycle. The unit further includes a fan for moving enclosure air through the indoor heat exchanger, and a fan for moving outdoor ambient air through the outdoor heat exchanger.

A first control including a sensing element exposed to the surface temperature of the outdoor coil is effective in causing the refrigeration system to reverse so that the outside heat exchanger functions as the condenser when its surface temperature indicates a frosting condition. The control also causes the outdoor fan to be de-energized to prevent the relatively cold outdoor air from moving through the outdoor coil during the defrosting operation, while at the same time energizing a heater associated with the indoor heat exchanger which is functioning as an evaporator so as to temper the air passing therethrough.

The control also provides a second control which includes a sensing element exposed to the outdoor ambient temperature. A switch under control of the sensing element has a first position for energizing the compressor when the ambient temperature sensed by the element is above the preselected low, and a second position for de-energizing the compressor and energizing a heating means when the temperature of the ambient air is below the preselected low.

A system control two-stage thermostat is also provided having a first switch operable for energizing the compressor in the heating cycle when the temperature of the enclosure is at a predetermined comfort level, and a second switch operable for energizing a second heating means in a manner that prevents both the first and second heater to be energized together with the compressor running.

DESCRIPTION OF THE PREFERRED EMBODIMENTS

Figure 1:
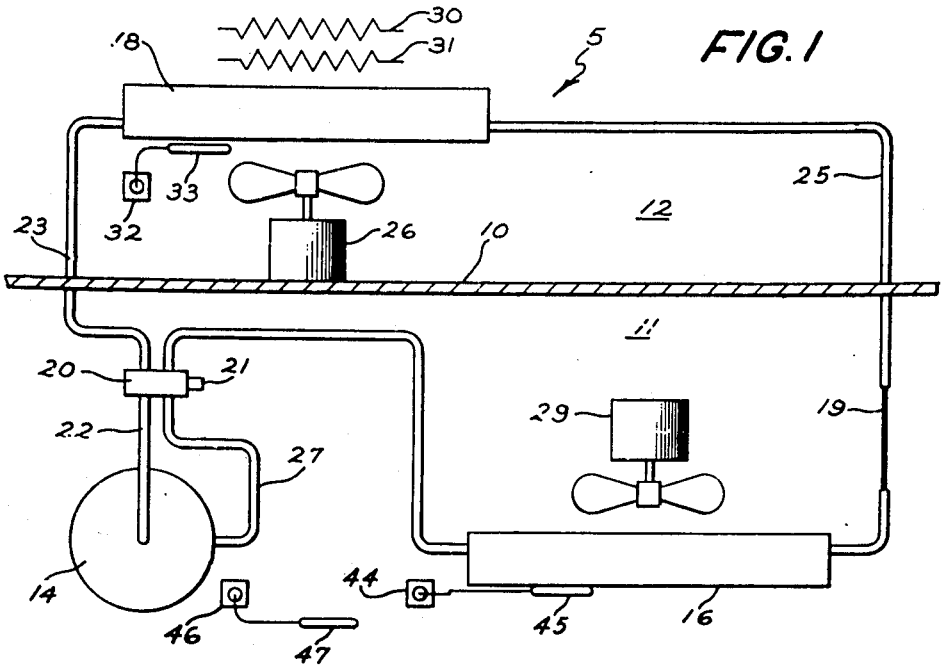
FIG. 1 is a diagrammatic view of a self-contained heat pump air conditioner unit embodying this invention.

Referring to FIG. 1 of the drawing, there is shown schematically an air conditioning refrigeration system 5 of the reversible or heat pump type divided by means of a partition 10 into an outdoor section 11 and an indoor section 12. A reverse cycle refrigeration system comprises a compressor 14 and an outdoor heat exchanger 16 mounted within the outdoor section 11 and an indoor heat exchanger 18 mounted within the indoor section 12. The outdoor heat exchanger 16 and indoor heat exchanger 18 are connected by means of a suitable flow restriction means such as a capillary tube 19 while the compressor is connected to the heat exchangers through a reversing valve 20 operated by a solenoid 21 so that the indoor heat exchanger 18 can be connected to the compressor either as an evaporator or as the condenser component of a refrigeration system.

During operation of the system as a heat pump or in the heating cycle, the reversing valve 20 directs the flow of high temperature refrigerant gas from the discharge line 22 of compressor 14 through a line 23 into the indoor heat exchanger 18 which then functions as a condenser to warm the air to be conditioned, and to condense the refrigerant gas into liquid form. The refrigerant is partially or completely condensed by the air circulated through the indoor heat exchanger 18 by the indoor fan 26. The refrigerant then flows through line 25 including expansion device 19 to the outdoor heat exchanger which is now functioning as an evaporator and then back through valve 20, suction line 27, and into the compressor 14.

During operation of the system in the cooling cycle, high pressure refrigerant gas is directed by the reversing valve 20 into the outdoor heat exchanger 16 through a line 28 where the high pressure refrigerant gas is condensed by the air circulated through heat exchanger 16 by the outdoor fan 29. The refrigerant then flows through line 25 including expansion device 19 to the indoor heat exchanger 18 which is now functioning as an evaporator and then back through line 23, valve 20, suction line 27 and into the compressor 14.

In accordance with the present invention, two auxiliary or supplemental heaters in the form of an electrical resistance heaters 30 and 31 are provided in the indoor section in the downstream path of air flowing through the indoor heat exchanger 18 for the purpose of supplying heat to the airstream under certain operating conditions when heat supplied by the indoor heat exchanger 18 operating as a condenser cannot satisfactorily maintain the enclosure being heated at a preselected temperature. As will be explained hereinafter, the heaters are used in combination with the operation of the refrigeration system in the heat pump cycle either to temper the indoor air passing through the relatively cold indoor heat exchanger functioning as the evaporator during defrosting of the outdoor heat exchanger, or for providing supplemental heating during the heating cycle.

Positioned within the indoor section 12 of the unit at some point in the airstream flowing through the heat exchanger 18 is a staged thermostat 32 which controls the operation of the unit on either the heating or the cooling cycle. This thermostat 32 is of the type well known in the art, and, as employed in the present embodiment of the invention, includes sensing means 33 responsive to the temperature of the indoor air for actuating a first stage switching means 34 movable between a cooling contact 34*a* and a heating contact 34*b* and a second stage switching means 35 movable relative to a contact 35*a* in a manner to be fully explained hereinafter. In the illustrated embodiment of the invention, this temperature responsive means 33 is arranged in the airstream flowing from the enclosure and into the indoor section 12 and then through the heat exchanger 18. The unit is also provided with a main or selector switch 36 (FIG. 2) through which electrical supply from supply lines 38–40 is connected to the unit and by means of which the operator of the unit may select operation thereof of the unit either through a heating switch 41 or through a cooling switch 42 to place the unit on either the heating or cooling cycle respectively.

In accordance with the present invention, the unit also includes a defrost control thermostat 44 and a heat control thermostat 46 which may be conveniently mounted in the outdoor section 11 and which are activated by sensing elements 45, 47 respectively. It should be noted that in practice the thermostats 44, 46 which may include adjusting knobs (not shown) can be arranged in the indoor section where they can be manipulated by the user of the unit, with sensing elements 45, 47 arranged in the outdoor section.

The defrosting sensing element 45 of control 44 is arranged to sense the surface temperature of the heat exchanger 16 and to maintain operation of the refrigeration system in the heat pump mode when the sensed surface temperature is above a preselected frost accumulation level, and to cause the reversing valve 20 to place the refrigeration system in the cooling mode so that the outdoor heat exchanger 16 functions as a condenser whenever the element 45 indicates an excessive frosting condition or temperature during operating of the unit on the heating cycle. To this end, while the exact location of the sensing element 45 relative to the heat exchanger may not be critical, it must however be arranged on the surface of the heat exchanger so that it continuously senses the temperature of the coldest portion of the outdoor heat exchanger 16. It is desirable in the defrost operation while the heat exchanger is functioning as a condenser, that the outdoor fan 29 be de-energized so that cold outdoor air which would impedede frosting is not forced through the outdoor heat exchanger. To this end, whenever element 45 senses the selected low frosting temperature, it causes the outdoor fan 29 to be de-energized in a manner to be explained hereinafter. Accordingly, the defrosting of the outdoor heat exchanger 16 is completed through control 44 by placing the refrigeration system in the cooling mode and by de-energizing fan 29 whenever the outdoor coil temperature is below a selected temperature. The outdoor heat exchanger functioning as the condenser with the relatively hot refrigerant gas passing therethrough causes any accumulation of frost to melt therefrom.

The heating control sensing element 47 of control 46 is arranged to sense the outdoor ambient temperature and to maintain the refrigeration system compressor 14 energized when the ambient outdoor temperature is above a preselected low temperature, and to interrupt operation of the compressor 14 when the ambient outdoor temperature is below the preselected low temperature. To this end, the sensing element 47 is arranged so that it continuously senses the outdoor temperature.

Figure 2:
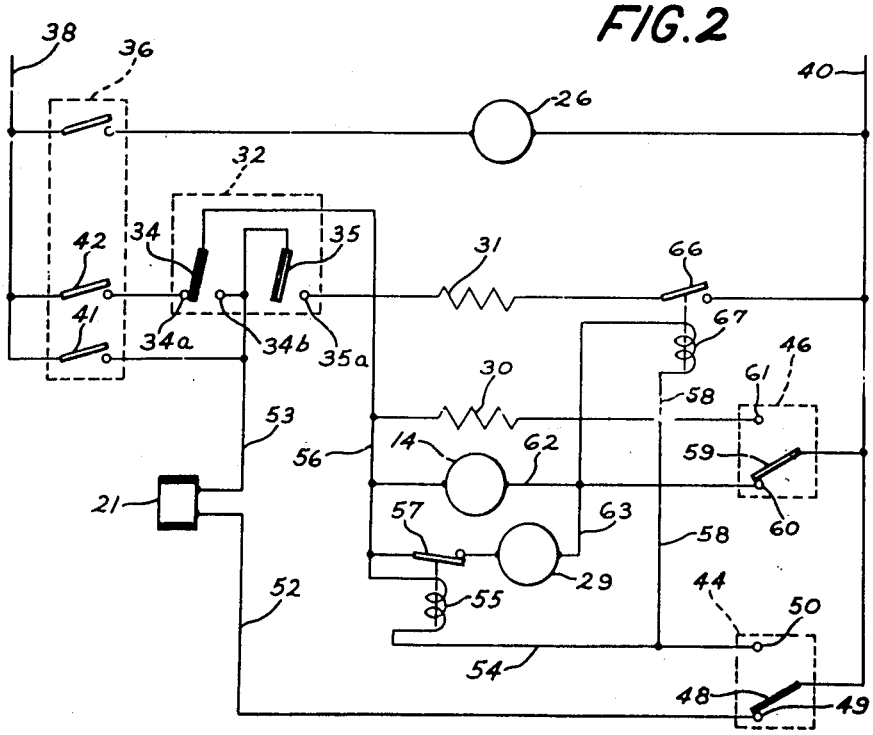
FIG. 2 is a simplified schematic diagram of electrical control circuitry adapted to control the unit in accordance with the present invention.

Referring now to FIG. 2 of the drawing, the control circuit and the operation of the air conditioner will now be described in detail. The defrost control 44 includes a thermal switching element 48 arranged for movement between contacts 49 and 50. When the surface temperature of the outdoor heat exchanger sensed by element 45 is above the selected low temperature, the switching element 48 is positioned on contact 49 as shown and a circuit is completed from power line 40 through contact 49, line 52, solenoid 21, line 53, heating switch 41 to power line 38. Accordingly, as long as the unit is in the heating mode and the temperature of the heat exchanger 16 is above the predetermined low temperature, a circuit is completed through the solenoid 21 and the refrigeration system will remain in the heating mode.

As mentioned hereinbefore, the fan 29 is de-energized when the defrost control element 45 senses a temperature below the selected low temperature. In the present embodiment, the solenoid 21 is de-energized when the sensing element 45 senses a surface temperature of 0° to −20° F., and energizes the solenoid at 35° to 55° F., at which time the outdoor heat exchanger 16 should be completely free of frost. To this end, when the temperature is below the selected low temperature, the switching element 48 moves away from its position on contact 49 to a position on contact 50. While the movement of switching element 48 from contacts 49 to 50 places the refrigeration system in the cooling cycle so that the outdoor heat exchanger functions as the system condenser and melts the frost, it also completes a circuit through contact 50, line 54, a fan control relay 55, line 56, contact **34*b* of first stage thermostat switch 34, heating switch 41 to line 38. The energization of relay 55 causes its normally closed switch 57 which as shown is in series with fan motor 29 to open and accordingly de-energize fan 29 so that the relatively cold outdoor ambient air is not forced through the heat exchanger 16** which at this time is functioning as the condenser and is being heated by the refrigerant gas passing therethrough.

In accordance with the present control system, auxiliary heater circuit is provided to the heater 30 during the defrosting operation so that enclosure air moving through the indoor heat exchanger 18, which is now functioning as the evaporator, is tempered before it enters the enclosure being air conditioned. To this end, with the switching element 48 positioned in its defrost position on contact 50, a circuit is completed therefrom through line 58, heater 30, line 56, contact **34*b* of first stage thermostat switch 34 and heat selector switch 41 to line 38**.

The compressor 14 and outdoor fan 29 are energized through the first stage switch 34 of thermostat 32 and heating control 46. The heating control 46 includes a thermal switching element 59 arranged for movement between contacts 60 and 61. When the ambient outdoor temperature sensed by element 47 is above the selected low temperature, the switching element 59 is positioned on contact 60 as shown and a circuit is completed from power line 40 through contact 60, line 62, compressor 14, line 56, first stage switch 34, heating switch 41 to power line 38. At the same time a circuit is completed from contact 60, line 63, fan 29, relay switch 57 to line 56.

The compressor 14 and fan 29 are accordingly de-energized when the ambient outdoor temperature is below a preselected low, causing switch element 59 to move away from contact 60. It should be noted that the selected low ambient temperature at which the compressor 14 and fan 29 are de-energized is determined by the ability of the unit operating in the heat mode to deliver enough heat to the enclosure to maintain a selected comfort level. The compressor 14 is de-energized by control 46 based on the lack of heating capacity of the unit in the heating mode when the temperature is below the selected ambient low which in the present embodiment is 0°±10° F. and energized when the ambient is 5°±15° F.

While the heater 30 is energized through control 44 during defrosting of heat exchanger 16, it is also energized through control 46 to provide supplemental heat during those times that the outdoor ambient temperature is such that the heat pump capacity is not sufficient to maintain the enclosure at the desired comfort level. To this end, as the switching element 59 of control 46 moves from contact 60 at 0°±10° F. to de-energize compressor 14 and fan 29 to a position on contact 61, it completes a circuit through heater 30 to line 56 so that heater 30 is energized each time control 46 de-energizes the compressor 14.

The thermostat 32 first stage switch 34 will remain positioned on heating contact **34*b* as long as the enclosure temperature is below a selected level. When the temperature of the enclosure during the heating operation drops due to the lack of capacity of the unit to elevate the temperature of the enclosure or to maintain a selected temperature, the second stage switch 35 moves to a position on its contact 35*a*. Operation of the second auxiliary or supplemental heater 31 is controlled by a relay 67 and is connected in series between switch 35 and line 40 with a normally open relay switch 66 between the contact 35*a* and line 40. Heater 31 can be energized only when the relay switch 66 is in its closed position. The relay switch 66 is operated between its normally open position and a closed position to energize heater 31 by a relay 67. The relay 67 is arranged in the circuit so that it will not be energized to close its switch 67 when both the compressor 14 and the heater 30** are energized. The following chart shows the various modes of the air conditioning unit components.

| Ambient Temp. Control 46 Switch Position | Surface Temp. Control 44 Switch Position | Relay Switch 66 | Compressor | Heater 30 | Heater 31 and Sw. 35 closed |
|---|---|---|---|---|---|
| 59–60 | 48–49 | Closed | On | Off | On |
| 59–60 | 48–50 | Open | On | On | Off |
| 59–61 | 48–49 | Closed | Off | On | On |
| 59–61 | 48–50 | Closed | Off | On | On |

Referring now to FIG. 2 and the above Chart, the relay 67 and accordingly heater 31 may be energized under the following conditions. With switch element 48 on contact 49 in the heat pump mode, and switch element 59 on contact 60, the relay 67 would be energized through heater 30, line 58, and control 46. In this instance, the compressor 14 and heater 31 would operate together if the thermostate second stage switch 35 were to close on demand for more heat, while the heater 30 in series with the relay coil 67 would be ineffective.

In the event switch element 59 moved over to contact 61 at the selected low temperature of 0°±10° F. to energize heater 30, a circuit to the relay 67 would then be completed through the now de-energized compressor 14. In this instance, both the heater 30 and 31 could be energized as long as the ambient temperature remains below 5°±10° F. This situation would be the same if switch element 48 moved to the defrost position on contact 50. However, with the switching element 48 on contact 50 and switching element 59 on contact 60 the compressor 14 is operating through control 46, and heater 30 is energized through control 44 and relay 67 cannot in this instance be energized. The electrical values of the present heaters 30 and 31 are such that when energized together with the compressor 14 the total current drawn by all three would exceed the current carrying capacity of the circuit breaker, causing it to open and de-energize the unit. Accordingly, by the present embodiment of the invention and as indicated in the above Chart, the compressor 14 and both heaters 30 and 31 are prevented from being energized at the same time by the operation of relay 67.

In summary, by the present invention, a control circuit is provided wherein a first control is effective when sensing a frosting condition of the outdoor heat exchanger to reverse the refrigerant cycle so that the outdoor coil functions as a condenser to melt any frost thereon. The control while reversing the refrigeration system also causes the outdoor fan to be de-energized to prevent the relatively cold outdoor air from passing through the heat exchanger, while at the same time energizing a heater associated with the indoor heat exchanger which is now functioning as the evaporator so that air passing therethrough is tempered as it is directed into the enclosure to be heated. A circuit is also completed to a heat control means that allows a second heater to be energized when the second stage switch of the two-stage thermostat calls for additional heating.

A second control is effective in de-energizing the compressor when sensing a preselected low ambient outdoor temperature while at the same time energizing the heater at the same time a circuit is completed to a heat control means that allows the second heater to be energized when the second stage switch of the two-stage room thermostat calls for additional heating.

While there has been shown and described a specific embodiment of the invention, it will be understood that it is not limited thereto and it is intended by the appended claims to cover all such modifications as fall within the true spirit and scope of the invention.

I claim:

1. In a self-contained air conditioning unit for heating and cooling an enclosure, a refrigerant circuit including an outdoor heat exchanger and indoor heat exchanger, a compressor, a reversing valve for selectively connecting said compressor to said heat exchangers whereby said outdoor heat exchanger functions as an evaporator during operation of said unit on the heating cycle and said indoor heat exchanger functions as an evaporator during operation of said unit on the cooling cycle, fan means for moving enclosure air through said indoor heat exchanger, fan means for moving outdoor ambient air through said outdoor heat exchanger, an air conditioner heating cycle control system comprising:

a first control means including a sensing element exposed to the surface temperature of said outdoor heat exchanger, switching means under control of said portion having a first position for energizing said reversing valve to maintain operation of said refrigerant circuit in the heating cycle when the surface temperature of said heat exchanger is above a preselected low, and a second defrost position for de-energizing said reversing valve for placing said refrigerant circuit in the cooling cycle when the surface temperature of said heat exchanger is below said preselected low so that said outdoor heat exchanger functions as a condenser to melt frost therefrom when present, and to de-energize said outdoor fan means to prevent ambient outdoor air from moving through said heat exchanger;

a second control means including a sensing element having a portion exposed to the outdoor ambient temperature, switching means under control of said portion having a first position for energizing said compressor when the ambient temperature sensed by said portion is above the preselected low, and a second position for de-energizing said compressor and energizing a heating means when the temperature of the ambient air is below the preselected low;

a thermostat means having a first switching means operable for energizing said compressor in said heating cycle when the temperature of said enclosure is a predetermined comfort level, and a second switching means operable when the temperature of said enclosure is below a predetermined comfort level for energizing a second heating means selectively with either said first heating means or said compressor.

2. The invention according to claim 1 wherein a control means for said second heater includes a relay having a switch in series with said second heater being operable to energize said second heater together with either said first heater or said compressor.

3. The invention according to claim 1 wherein outdoor fan control means including a switch in series with said outdoor fan motor being energized when said first control means is in said second position so that said fan motor is de-energized when said first control senses a temperature below said selected low temperature.

4. In a self-contained air conditioning unit for heating and cooling an enclosure, a refrigerant circuit including an outdoor heat exchanger and indoor heat exchanger, a compressor, a reversing valve for selectively connecting said compressor to said heat exchangers whereby said outdoor heat exchanger functions as an evaporator during operation of said unit on the heating cycle and said indoor heat exchanger functions as an evaporator during operation of said unit on the cooling cycle, fan means for moving enclosure air through said indoor heat exchanger, a first and second heater means arranged downstream, fan means for moving outdoor ambient air through said outdoor heat exchanger, an air conditioner heating cycle control system comprising:

(a) a first and second heater means associated with said indoor heat exchanger being positioned downstream in the path of air moving therethrough;

(b) a first control means including a sensing element having a portion exposed to the surface temperature of said outdoor heat exchanger;

(i.) switching means under control of said portion having a first position for energizing said reversing valve to maintain operation of said refrigerant circuit in the heating cycle when the surface temperature of said heat exchanger is above a preselected low, and a second defrost position for de-energizing said reversing valve for placing said refrigerant circuit in the cooling cycle when the surface temperature of said heat exchanger is below said preselected low so that said outdoor heat exchanger functions as a condenser to melt frost therefrom when present;

(ii.) an outdoor fan control circuit being completed in said second switch position for de-energizing said outdoor fan means to prevent outdoor ambient from moving through said outdoor heat exchanger during defrost;

(iii.) an auxiliary heater circuit being completed in said second position for energizing said first heater means to warm the air moving through said indoor heat exchanger which in the defrost position of said frost control is functioning as an evaporator;

(c) a second control means including a sensing element having a portion exposed to the outdoor ambient temperature;

(i.) switching means under control of said portion having a first position for energizing said compressor when the ambient temperature sensed by said portion is above the preselected low, and a second position for de-energizing said compressor when the temperature of the ambient air is below the preselected low;

(d) a thermostat means having a first switching means operable for energizing said compressor in said heating cycle when the temperature of said enclosure is at a predetermined comfort level, and a second switching means operable for energizing said second heating means;

a second heater control means including a relay having a switch in series with said second heater for energizing said second heater either with said first heater or said compressor.

5. The invention according to claim 4 wherein a control means for said second heater includes a switch in series with said second heater means being energized when either of said first or second control switching means is in its second position.

6. The invention according to claim 5 wherein outdoor fan control means including a switch in series with said outdoor fan motor being energized when said first control means is in said second position so that said fan motor is de-energized when said first control senses a temperature below said selected low temperature.

* * * * *